US006361784B1

(12) United States Patent
Brennan et al.

(10) Patent No.: US 6,361,784 B1
(45) Date of Patent: Mar. 26, 2002

(54) SOFT, FLEXIBLE DISPOSABLE WIPE WITH EMBOSSING

(75) Inventors: Jonathan Paul Brennan, Cincinnati; Lester Charles Sporing, Loveland, both of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/676,205

(22) Filed: Sep. 29, 2000

(51) Int. Cl.[7] ..... A01N 25/34
(52) U.S. Cl. ..... 424/402; 424/404
(58) Field of Search ..... 424/402, 404; 428/137; 654/380

(56) References Cited

U.S. PATENT DOCUMENTS 4,900,377 A 2/1990 Redford et al.
5,292,581 A * 3/1994 Viazmensky et al. ..... 428/288
5,476,711 A * 12/1995 Hebbard et al. ..... 428/283
D400,716 S * 11/1998 Sporing et al. ..... D5/26
5,964,742 A 10/1999 McCormack et al.
6,602,505 * 2/2000 Srinivasan et al. ..... 428/137
6,054,202 A * 4/2000 Takeuchi et al. ..... 428/167

* cited by examiner

*Primary Examiner*—Thurman K. Page
*Assistant Examiner*—Rachel M. Bennett
(74) *Attorney, Agent, or Firm*—Ian S. Robinson; Roddy M. Bullock; Ken K. Patel

(57) ABSTRACT

A nonwoven wipe suitable for use as a pre-moistened baby wipe comprised of thermoplastic fibers having a predetermined nominal fiber length, the wipe being calendar-embossed with a pattern comprising a plurality of discrete icons, each of the icons having an equivalent icon diameter of at least about one half the nominal fiber length, and the plurality of icons being separated one from another by an equivalent unbonded area diameter of at least about one half the nominal fiber length. In a preferred embodiment the nonwoven web is spunlaced, with a fiber composition of between about 40%–60% viscose, and the remainder thermoplastic fiber. The wipes of the present invention combine superior softness with embossed designs for better aesthetic appeal.

26 Claims, 7 Drawing Sheets

PRIOR ART

SOFT, FLEXIBLE DISPOSABLE WIPE WITH EMBOSSING

FIELD OF THE INVENTION

The present invention is related to disposable wiping articles, and more particularly to pre-moistened wipes suitable for use as baby wipes.

BACKGROUND OF THE INVENTION

Pre-moistened cleansing wipes are well known, and are often referred to as wet wipes, towelettes, and the like. Pre-moistened wipes include a substrate, such as a nonwoven web, pre-moistened with a lotion. The lotion can be an aqueous lotion, and may include skin conditioning ingredients. One preferred lotion comprises polymeric emulsifiers, such as sodium acrylates, and silicon oil, such as dimethicone in an oil-in-water emulsion type formulation.

Lotions can also include one or more surface active materials (surfactants). The lotion can also include preservative and fragrance ingredients. In another format, wipes can be dry, and moistened by the user at the time of use. Therefore, although the present invention is believed to be most useful as a pre-moistened wipe suitable for use as a baby wipe, it may also find use as a dry wipe which the ultimate user may moisten as desired.

Pre-moistened wipes find use at home or away from home, especially with the cleansing of children and infants. For example, wipes are often used to clean an infant's skin during a diaper change. As well, pre-moistened wipes find use among adults, often in conjunction with the use of incontinence articles. Other uses of pre-moistened wipes include general cleaning tasks where soap, cloths, and running water may be unavailable, unsuitable, or inconvenient for a particular task. In almost all instances, pre-moistened wipes are provided as folded, stacked, sheets of disposable wipes, each wipe meant for one-time use. Pre-moistened wipes are often referred to as disposable wet wipes.

Historically various types of nonwoven webs have been utilized for use as disposable wet wipes. The various types of nonwovens differ in visual and tactile properties, usually due to the particular production process used in their manufacture. In all cases, however, consumers of disposable wipes suitable for use as baby wipes demand softness and flexibility in addition to other functional attributes such as cleaning ability. Softness and flexibility can be correlated to certain measurable physical parameters, but perceived softness is often more subjective in nature, and consumers often react to visual and tactile properties in their assessment of wet wipes.

By way of example, The Procter & Gamble Co. of Cincinnati OH markets PAMPERS® Baby Fresh™ wipes in North America, the nonwoven substrates of which are manufactured via an airlaid adhesive-bonded process that includes the imprinting of calendar-embossed designs that are permanent even when wet. The nonwoven web has a dry basis weight of about 63.6 grams per square meter (gsm) and a thickness when wet of about 0.61 mm. The embossed pattern provides a visually-pleasing effect which gives added consumer recognition and appeal. Moreover, consumers perceive certain embossed designs as imparting softness, which in some cases may be technically true. Consequently, PAMPERS® Baby Fresh™ wipes have enjoyed significant commercial success in the United States.

In Europe, however, The Procter & Gamble Co. markets PAMPERS® Baby Fresh disposable wipes, the nonwoven substrates of which are manufactured via a spunlace process and are not embossed with any designs. The nonwoven web has a dry basis weight of about 60–62 gsm, and a thickness when wet of about 0.52 mm. Although there is no visual signal of softness such as embossed designs, the lack of thermal or chemical bonds in the spunlaced web results in very low elastic modulus and bending torque. The combination of low elastic modulus, low bending torque, and appropriate fiber choice give these wipes superior inherent softness. These disposable wipes have enjoyed significant commercial success in many parts of Europe, for example the United Kingdom.

It has been found, therefore, that when appropriate fibers are utilized, the spunlace process produces a relatively soft, flexible and strong nonwoven web suitable for use as disposable baby wipes. However, when embossed to provide additional aesthetic appeal, particularly to North American consumers, it has been found that the flexibility is unacceptably decreased (i.e., stiffness increases noticeably, such that consumers, especially in Europe, indicate disapproval). Rather than marketing two different products to the world's consumers, it would be economically advantageous to find a common product that combines the visual aesthetic appeal of embossed wet wipes with the inherent softness of un-embossed spunlace-produced wet wipes.

Accordingly, it would be desirable to provide a substrate suitable for use as a pre-moistened wipe that combines the visual aesthetic appeal of air-laid embossed wet wipes with the inherent softness of un-embossed spunlace-produced wet wipes.

Additionally, it would be desirable to provide a pre-moistened wipe that can be successfully marketed to consumers in both North America and Europe.

Further, it would be desirable to provide an embossed spunlace nonwoven web that exhibits permanent embossed patterns when wet, and which does not exhibit increased stiffness relative to the precursor (i.e., un-embossed) web.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

SUMMARY OF THE INVENTION

Figure 1:
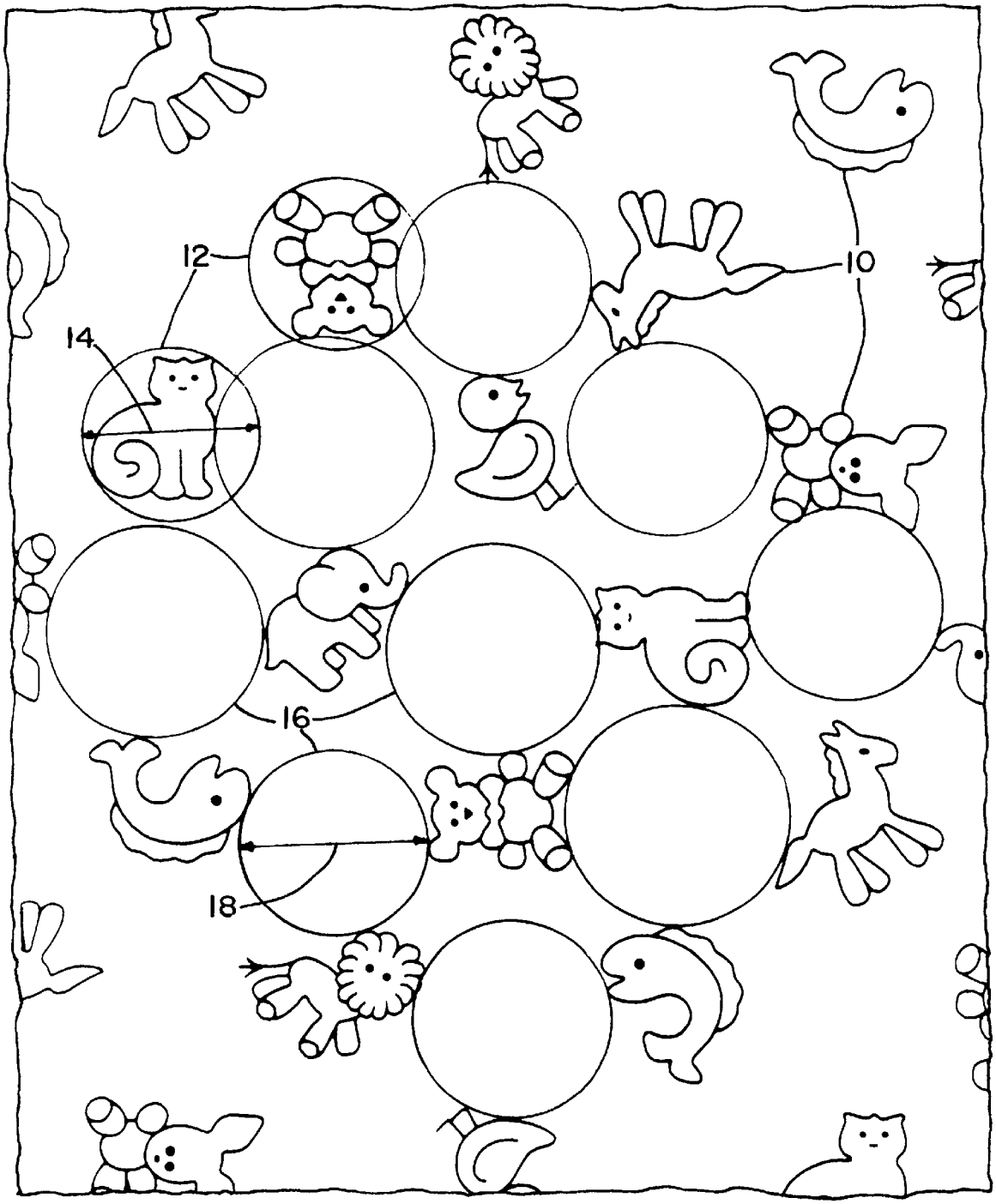
FIG. 1 is a plan view of one emboss pattern of a wipe of the present invention.

A nonwoven wipe suitable for use as a pre-moistened baby wipe is disclosed. The nonwoven is comprised of fibers, including thermoplastic fibers, having a predetermined nominal fiber length, the wipe being calendar-embossed with a pattern comprising a plurality of discrete icons, each of the icons having an equivalent icon diameter of at least about one half the nominal fiber length, and the plurality of icons being separated one from another by an equivalent unbonded area diameter of at least about one half the nominal fiber length. In a preferred embodiment the nonwoven web is spunlaced, with a fiber composition of between about 40%–60% viscose, and the remainder thermoplastic fiber. The wipes of the present invention combine superior softness with embossed designs for better aesthetic appeal.

DETAILED DESCRIPTION OF THE INVENTION

The wipes of the present invention comprise a nonwoven substrate having a predetermined embossed pattern. The wipe is preferably a pre-moistened wipe which is moistened with a lotion after being embossed. The substrate can comprise a nonwoven web formed of natural fibers, synthetic fibers, or combinations thereof suitable for use as a pre-moistened wipe such as a wet wipe, and is preferably a soft, flexible nonwoven produced via the spunlace process. The lotion can comprise an aqueous solution and can include a surfactant and/or a cosurfactant/foam building agent/emulsifier and/or a non-cellulosic water soluble organic polymer.

The wipes of the present invention are particularly suitable for dispensing from a tub of stacked, folded wipes, and more preferably for dispensing as "pop-up" wipes, in which upon pulling a wipe out of the tub, an edge of the next wipe is presented for easy dispensing. The wipes of the present invention can be folded in any of various known folding patterns, such as C-folding, but is preferably Z-folded. A Z-folded configuration enables a folded stack of wipes to be interleaved with overlapping portions. Preferred fold patterns are disclosed more fully in commonly assigned, co-pending U.S. patent application, Ser. No. 09/344,695, Case 7496R, filed on Jun. 25, 1999, which is hereby incorporated herein by reference.

The term "nonwoven" as used herein refers to a sheet, web, or batt of directionally or randomly oriented fibers, bonded by friction, and/or cohesion and/or adhesion, excluding paper, tissue paper, and products which are woven, knitted, tufted, or stitch-bonded. A web is considered to be a paper web, and therefore categorically not included as a web of the present invention, if the constituent fibers have a length to diameter ratio less than 300, or a nominal (or average) fiber length of less than about 1 mm.

The term "aqueous solution" as used herein refers to a solution that is at least 50 percent by weight water, more preferably at least 75% by weight water, and most preferably at least 94% by weight water.

The term "pre-moistened wipe" as used herein refers to a wipe which includes a substrate which is moistened, such as by wetting the substrate with a liquid composition, prior to use by the consumer. In particular, "pre-moistened wipe" refers to wipes having a substrate which is moistened prior to packaging, such as in a generally moisture impervious container or wrapper.

Pre-moistened wipes, which can also be referred to as "wet wipes" and "towelettes", are suitable for use in cleaning babies, and can also find use in cleaning tasks related to persons of all ages. Such wipes can also include articles used for application of substances to the body, including but not limited to application of make-up, skin conditioners, ointments, sun-screens, insect repellents, and medications. Such wipes can also include such articles used for cleaning or grooming of pets, and articles used for general cleansing of surfaces and objects, such as household kitchen and bathroom surfaces, eyeglasses, exercise and athletic equipment, automotive surfaces, and the like.

As used herein, when used in relation to material compositions the terms "%", "percent", "weight percent" or "percent by weight" refer to the quantity by weight of a component as a percentage of the total, unless indicated otherwise.

As used herein, the term "basis weight" means the weight per unit area of the wipe, or the nonwoven web substrate. One method of determining basis weight, therefore, is to multiply the density of the web by the thickness of the web. The units of basis weight are typically expressed as grams per square meter.

As used herein, the term "water soluble" means that a component is soluble or otherwise dispersible (such as to provide a micellar solution) in water at a level of at least about 0.25 percent by weight at 25 degrees Centigrade.

As used herein, the term "surfactant" refers to materials which preferably orient toward an interface, classes of surfactants including nonionic surfactants, anionic surfactants, cationic surfactants, amphoteric surfactants, zwitterionic surfactants, and mixtures thereof.

As used herein, the terms "emulsifier" or "solubilizer" refer to a component that reduces the tendency of one or more other components in a lotion composition to phase separate from the lotion.

As used herein, the term "cosurfactant" means a component that can act as either a surfactant or an emulsifier/solubilizer.

As used herein the term "organic water soluble polymer" means an organic compound formed by the joining of smaller molecules, referred to as monomers. The term is generally used to refer either to a macromolecule made up of a large number of monomers linked by covalent bonds, e.g., polypeptides, nucleic acids, polysaccharides, and plastics, or to a protein made up of several subunits linked by covalent or noncovalent bonds, e.g., hemoglobin or lgM immunoglobulin.

As used herein with respect to nonwoven webs, the term "machine-direction" refers to the direction of web travel as the nonwoven web is produced, for example on commercial nonwoven making equipment. Likewise, the term "cross-direction" refers to the direction in the plane of the web perpendicular to the machine-direction. With respect to individual wipes, the terms refer to the corresponding directions of the wipe with respect to the web the wipe was made from. These directions are carefully distinguished herein because the mechanical properties of nonwoven webs can differ, depending on how the test sample is oriented during testing. For example, tensile properties of a nonwoven web differ between the machine-direction and the cross-direction, due to the orientation of the constituent fibers, and other process-related factors.

For disposable wet wipes suitable for baby wipes, it has been found that softness, flexibility and thickness of the wipe all contribute to consumer satisfaction. It has been found that these consumer-preferred attributes are significantly impacted by the method of making the nonwoven substrate, and the presence or absence of aesthetically pleasing embossed designs. In an effort to quantify, measure, and design in preferred softness and flexibility parameters in a wet wipe, extensive consumer panel testing was performed.

The results of the consumer panel testing revealed that, for a given thickness of the wipe itself, cross-direction (CD) mechanical properties of elastic modulus and bending torque are the most relevant technical measures of consumer-acceptable softness and flexibility. Beyond simply being technically soft and flexible, however, an additional requirement for commercially successful baby wipes in North America is the presence of aesthetically-pleasing embossed designs that can signal added softness and quality to consumers.

Preferred embodiments of wipes of the present invention are disclosed below with reference to the FIGURES for purposes of illustrating examples of beneficial substrates and embossing patterns.

SUBSTRATE

The wipe 1 of the present invention can comprise a substrate comprising a nonwoven web of natural fibers, synthetic fibers, or mixtures of natural and synthetic fibers. Suitable natural fibers include but are not limited to cellulosic fibers, such as wood pulp fibers, cotton, and rayon. Suitable synthetic fibers include fibers commonly used in textiles, including but not limited to polyolefins, such as polyester and polypropylene fibers. In a preferred embodiment viscose (rayon) is used in combination with polypropylene for an economical balance of softness and bondability (in embossing). The viscose provides excellent softness and clothlike properties, but used alone tends to produce a flannel-like web, which is not currently preferred by consumers of baby wipes. Polypropylene permits the web to be thermally bonded in an embossing step, but used alone produces a web that is too slick and synthetic-feeling for consumers of baby wipes. Blending the two types of fibers changes the flannel-like feel of the viscose fibers into a more silky-feel, which gives the wipes a silky-soft feel, which is consumer approved for baby wipes.

Beyond the particular fiber composition of the nonwoven web, for consumer-preferred, soft, flexible baby wipes, two technical measures have been identified as being most relevant: cross-direction (CD) bending torque, and CD elastic modulus. Both of these technical measures are determined by way of the methods disclosed in the Test Methods section below. Both technical measures are disclosed herein as made on the lotioned, i.e., wet, wipe. Currently preferred substrates have CD bending torque values less than about 0.017 gm-cm, and CD modulus values of less than about 200 g/in (7.874 g/mm)

Currently, the preferred process for producing very soft, flexible, "drapy" webs having very low CD modulus characteristics is spunlacing. Spunlacing technology is a known method of producing nonwoven webs, and involves laying down a matrix of fibers, for example as a carded web, and entangling the fibers to form a coherent web. Entangling is typically accomplished by impinging the matrix of fibers with high pressure water from a plurality of suitably-placed water jets, often referred to as hydroentangling. In theory, other fluids can be used as the impinging medium, such as compressed air. The fibers of the web are thus entangled, but not physically bonded one to another. The fibers of a spunlaced web, therefore, have more freedom of movement than fibers of webs formed by thermal or chemical bonding. Particularly when lubricated by wetting as a pre-moistened wet wipe, such spunlaced webs provide webs having very low bending torques and low moduli.

For use as a pre-moistened wipe, webs of the present invention have a dry basis eight of between about 55 grams per square meter (gsm) and 75 gsm, more preferably between about 60 gsm and 70 gsm. Currently preferred embodiments have a dry basis eight between about 60–62 gsm. A preferred spunlaced web of the present invention is available from the J. W. Suominen Company of Finland, and sold under the Fibrella trade name. In particular, Fibrella 3100 and Fibrella 3160 have been found to be useful as precursor webs of the present invention. Fibrella 3100 is a 62 gsm nonwoven web comprising 50% 1.5 denier polypropylene fibers and 50% 1.5 denier viscose fibers. Fibrella 3160 is a 60 gsm nonwoven web comprising 60% 1.5 denier polypropylene fibers and 40% 1.5 denier viscose fibers. In both preferred webs, the average fiber length is about 1.5 inches (about 3.8 cm). Average fiber length refers to the length of the individual fibers if straightened out.

The pre-moistened wipe is made by wetting the dry substrate with at least 1 gram of liquid lotion per gram of dry fibrous web. Preferably, the dry substrate is wetted with at least about 2.0 grams, and more preferably at least about 2.5 grams, and in one embodiment between about 3.2 and 3.4 grams of liquid lotion was added per gram of the dry fibrous web.

The spunlaced web of the present invention has excellent softness and flexibility. For example, the above-mentioned spunlaced webs from Suominen each have a CD bending torque of about 0.013 gm-cm, and a CD modulus of about 134 g/in. These measurable technical parameters correlate well with consumer-tested softness levels. As such, spunlaced webs suitable for use as wet wipes can be utilized successfully for pre-moistened baby wipes, due to their inherent softness and flexibility.

As mentioned above, however, for a consumer-acceptable baby wipe in North America, it is desirable to have an embossed pattern that signals additional softness and which otherwise provides additional aesthetic appeal. The embossed pattern should be visible when wet. However, embossing is typically used to increase the modulus of nonwoven webs, thereby usually also increasing the strength of the web. As such, embossing by known methods, and in particular with known patterns for nonwoven webs, tends to dramatically increase the bending torque and/or the modulus of the materials. Such increases in these mechanical properties is undesirable, and commercially unacceptable for soft, flexible baby wipes.

One method of providing an embossed pattern is via known thermal calendar-bonding with known patterns. In a calendar-bonding process the nonwoven web is fed into the nip of two counter-rotating calendar rollers, at least one of which is heated and comprises raised areas that compress and melt-bond adjacent fibers of the nonwoven web in the compressed regions. While being a good method of embossing, such melt-bonding and re-solidifying of the fibers tends to stiffen the web, making it unsatisfactory for use as a baby wipe. For example, in the above-mentioned Fibrella spunlaced webs from Suominen embossing can bind adjacent polypropylene fibers, impeding the free (or semi-free) movement of adjacent fibers, thus creating a stiffer structure.

The web of the present invention overcomes the above-mentioned problems associated with known embossing methods, and exhibits consumer-approved levels of softness with aesthetically-pleasing embossing. When embossed as described herein a spunlaced web can have permanent when wet embossed designs with little or no increase in CD bending torque or CD modulus.

In general, it has been found that by embossing by the method described herein a spunlaced web formed from an airlaid or carded web comprised of fibers having a predetermined nominal (or average) fiber length of from about 0.75 inch (1.9 cm) to about 3 inches (7.6 cm) the original bending torque and modulus properties of the precursor web can be substantially preserved. Fiber lengths are predetermined, and supplied by the fiber maker as staple fibers in nominal lengths, which can be specified as average lengths. Typical fiber lengths for carded webs are nominally 1.5 inches (38.1 mm) and 1 9/16 inches (39.7 mm).

By way of comparison, spunbond webs comprise continuous fibers thermally bonded to one another, which results in relatively stiff nonwoven web structures.

Meltblown fibers, although discontinuous, are melt-bonded to adjacent fibers, which also results in a relatively stiff web.

Although not considered a nonwoven for the purposes of the present invention, paper, for example wet-laid tissue paper, typically comprises very short fibers, on the order of three millimeters or less.

The constituent fibers of the web of the present invention can be circular in cross-section, dog bone shaped, delta (i.e., triangular cross-section), tri-lobal, ribbon, or other shapes typically produced as staple fibers. Likewise, the fibers can be conjugate fibers, such as bicomponent fibers. Staple fibers may be crimped, and may have a finish, such as a lubricant, applied.

The method of embossing a web of the present invention involves calendar embossing the web with discrete "icons", each icon having an equivalent icon diameter greater than half the nominal fiber length of the precursor web, and each icon being separated from adjacent icons by an equivalent unbonded area diameter greater than half the nominal fiber length.

By "icon" as used herein is meant a single, discrete, design or shape, such as a flower, clown, bunny, elephant, or other design, formed essentially as a line drawing. While certain icons may have portions not describable as a "line" (such as eyes of animals, etc.), the overall design comprises primarily lines in a pattern to make the design or shape.

By "equivalent icon diameter" as used herein is meant the diameter of the smallest circle that can circumscribe (i.e., be drawn about and encompass) the complete icon. Circumscribing the icon means that at least two points on the icon tangentially contact the circle, and no portion of the icon crosses outside of the circle. Of course, circumscribing does not require a literal circle to be drawn or marked on the substrate. Any method, including optical methods of superposing circles could be used to determine equivalent icon diameters. For the purposes of the present invention, equivalent icon diameters were determined as shown in the Test Methods section below.

Figure 2:
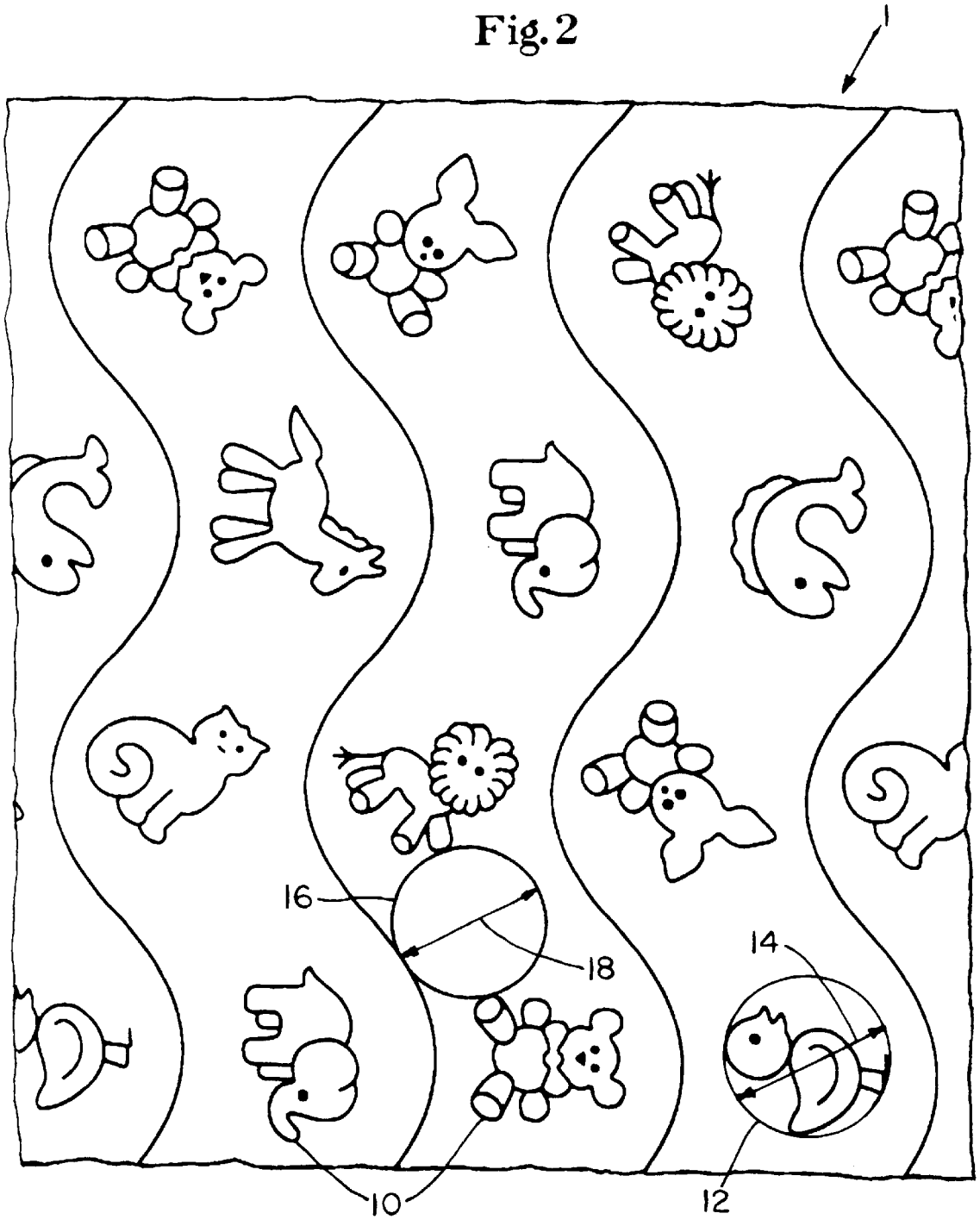
FIG. 2 is plan view of another emboss pattern of a wipe of the present invention.

By "equivalent unbonded area diameter" as used herein is meant the diameter of the largest circle that can be circumscribed between icons, but not include any embossed portions within it Circumscribing between icons means that at least one point on at least three icons, (or other continuous embossments such as straight or wavy lines, as shown in FIG. 2), tangentially contacts the circle, and no portion of any icon crosses inside the circle. Of course, circumscribing does not require a literal circle to be drawn or marked on the substrate. Any method, including optical methods of superposing circles could be used to determine equivalent icon diameters. For the purposes of the present invention, equivalent unbonded area diameters were determined as shown in the Test Methods section below.

When varying sizes and/or spacings of icons are used in the emboss pattern, an average of all diameters is used for the equivalent icon diameter. However, if varying sizes of icons are used, the smallest icon should be have an equivalent icon diameter greater than about one-half the average fiber length. Likewise, the smallest spacing between icons should have an equivalent unbonded area diameter greater than about one-half the average fiber length.

Without being bound by theory, it is believed that the above described limits are necessary for the production of a consumer-acceptable nonwoven webs for use as baby wipes. However, it is not intended that insubstantial deviations from the above-mentioned limits should avoid the scope of the claims. For example, a web having an insubstantial number of icons having an equivalent unbonded area diameter less than about one-half the average fiber length would be considered to have insubstantial differences relative to the web of the present invention.

Without being bound by theory, it is believed that the unexpected softness and flexibility properties of the wipe of the present invention are due to the lack of a continuous pattern, such a grid or criss-cross pattern of embossments that could "lock up" adjacent fibers and decrease the flexibility of the web. By making the embossed patterns as described above, very few fibers of the web are physically bonded to adjacent fibers, so that the fibers remain essentially free to move relative to one another.

Therefore, in one embodiment the wipe can be described as a wipe comprising a nonwoven web comprised of fibers having a predetermined nominal fiber length, and an embossed pattern comprising a plurality of discrete icons, each icon having an equivalent icon diameter of at least one half the nominal fiber length, and the plurality of icons being separated one from another by an equivalent unbonded area diameter of at least one half the nominal fiber length.

Without being bound by theory, it also appears that the total percent bond area, that is, the percent of embossed area of the wipe substrate is also important. The embossed area is essentially equal to the land area of the embossing protrusions when calendar embossing is used. In particular, it is believed that bond areas greater than about 8% render the wet wipe too stiff, and thus softness, or perceived softness decreases. Likewise, under about 4% bond area there may not be enough calendared, embossed regions to give sufficient visual qualities to the wipe, such that the user perceives the aesthetic look and feel of the wipe. Total percent bond area is determined as set forth in the Test Methods section below.

By way of example, several different embodiments of bond patterns are described below, with respect to the Figures. For each of the bond patterns described, the precursor web was a spunlaced web, purchased from Suominen under the trade name Fibrella 3160. The web was a 60 gsm web comprising 60% 1.5 denier polypropylene and 40% 1.5 denier viscose. The nominal fiber length was 1.5 inches (about 3.8 cm).

TABLE 1

| Sample No. | Equivalent Icon Diameter (inches) | Equivalent Unbonded Area Diameter (inches) | % Bond Area | CD Bending Torque (gm-cm) | CD Modulus (g/in) |
|---|---|---|---|---|---|
| | Examples | | | | |
| Control (no emboss) | | | 0.0 | 0.013 | 134 |
| Sample 1 | 1.5325 | 1.3418 | 4.1 | 0.011 | 155 |
| Sample 2 | 1.5325 | 1.27 | 7.2 | 0.014 | 152 |
| Sample 3 | 1.5325 | 0.68 | 6.7 | 0.010 | 162 |
| Sample 4 | 0.6913 | 1.155 | 4.9 | 0.013 | 139 |
| Sample 5 | 0.7227 | 0.655 | 8.0 | 0.014 | 196 |
| Sample 6 | 0.7227 | 0.318 | 15.3 | 0.017 | 305 |

The sample labeled "Control" in Table 1 represents the base, or precursor, nonwoven web without any emboss pattern. As mentioned above, this web represents a web having excellent softness and flexibility, both attributes which correlate well with consumer data on softness levels. This base nonwoven web would make an excellent wet wipe for disposable baby wipes, but it lacks the visual softness signals provided by embossing. Particularly in certain regions, such as North America, embossed patterns are necessary for consumer appeal.

The embossed pattern of Sample 1 is shown in FIG. 1. The icons 10 are shown as animals formed primarily as line drawings. Around each icon 10 can be circumscribed a circle 12 which has an equivalent icon diameter 14. Likewise, between icons can be circumscribed a circle 16 which has an equivalent unbonded area diameter 18. Sample 1 represents an embossed pattern having a relatively low percent bond area (4.1%). While in general a low percent bond area is preferred, it is believed that below about 3–4% the icons are either too large (as open line figures), or too sparsely spaced to be effective as aesthetically-pleasing visual indicators on baby wipes.

The embossed pattern of Sample 2 is shown in FIG. 2. In this pattern, the icons are interspersed with wavy lines which form part of the overall embossed pattern. Wavy lines, which are not considered to be icons but do form a boundary for the equivalent unbonded area, are believed acceptable as long as they do not form a grid pattern, or otherwise lock up fibers with adjacent fibers in the nonwoven web. Therefore, it is believed that if generally parallel and/or wavy lines are incorporated in the embossed pattern, they should not intersect, and they should be spaced apart a distance at least equal to half the nominal fiber length.

As shown in FIG. 2, around each icon 10 on Sample 2 can be circumscribed a circle 12 which has an equivalent icon diameter 14. Likewise, between icons and the wavy lines can be circumscribed a circle 16 which has an equivalent unbonded area diameter 18. Sample 2 represents an embossed pattern having a relatively high percent bond area (7.2%) for webs of the present invention.

Figure 3:
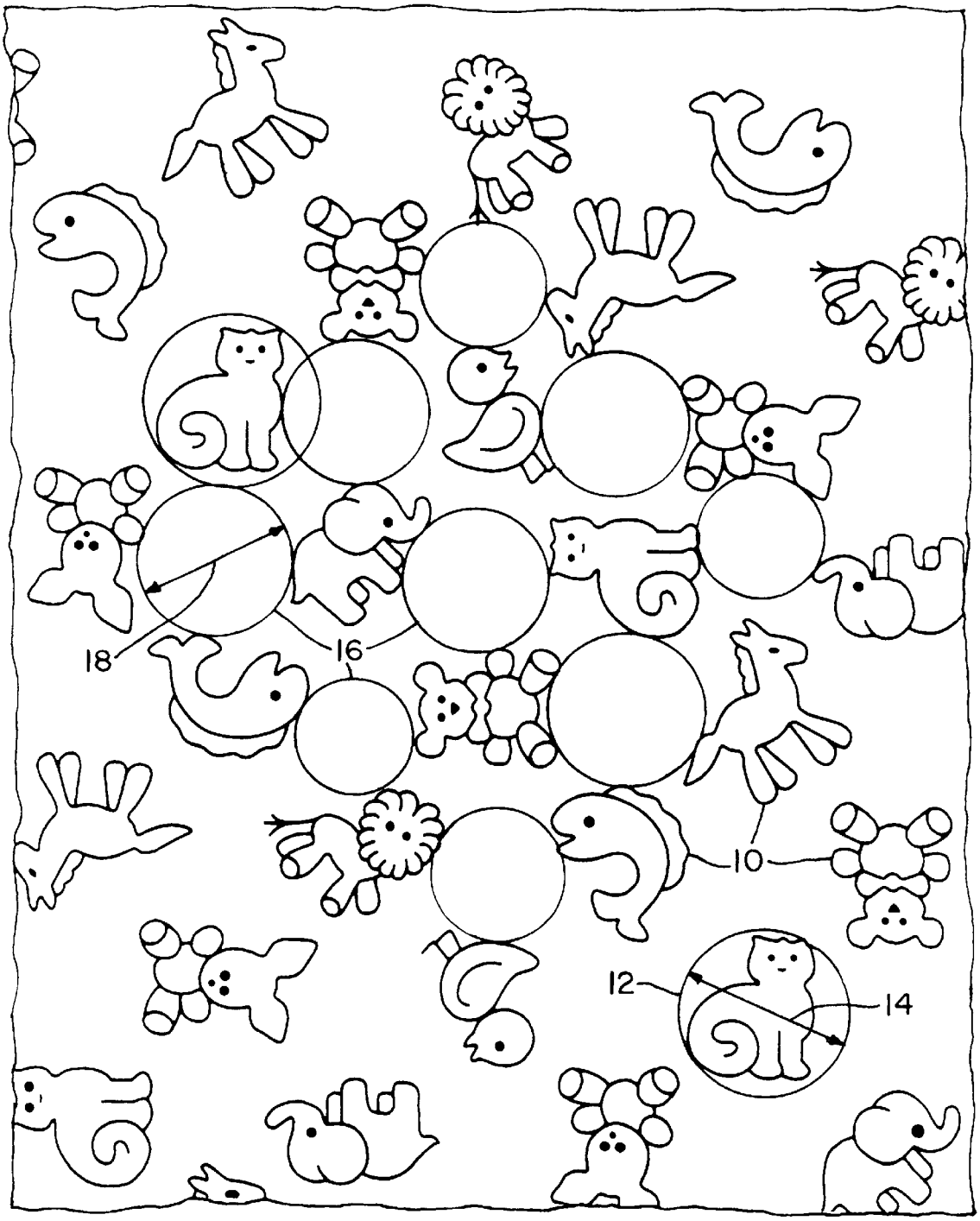
FIG. 3 is plan view of another emboss pattern of a wipe of the present invention.

The embossed pattern of Sample 3 is shown in FIG. 3. The icons 10 are the same as shown in FIG. 1, but the icon-to-icon spacing is decreased. As before, around each icon 10 can be circumscribed a circle 12 which has an equivalent icon diameter 14. Likewise, between icons can be circumscribed a circle 16 which has an equivalent unbonded area diameter 18 . The CD bending torque is shown in Table 1 as being less than the precursor web. This is believed to be due to measurement error, such that the bending torque value of Sample 3 is essentially the same as the precursor web. Sample 3 represents an embossed pattern having a relatively high percent bond area (6.7%).

Figure 4:
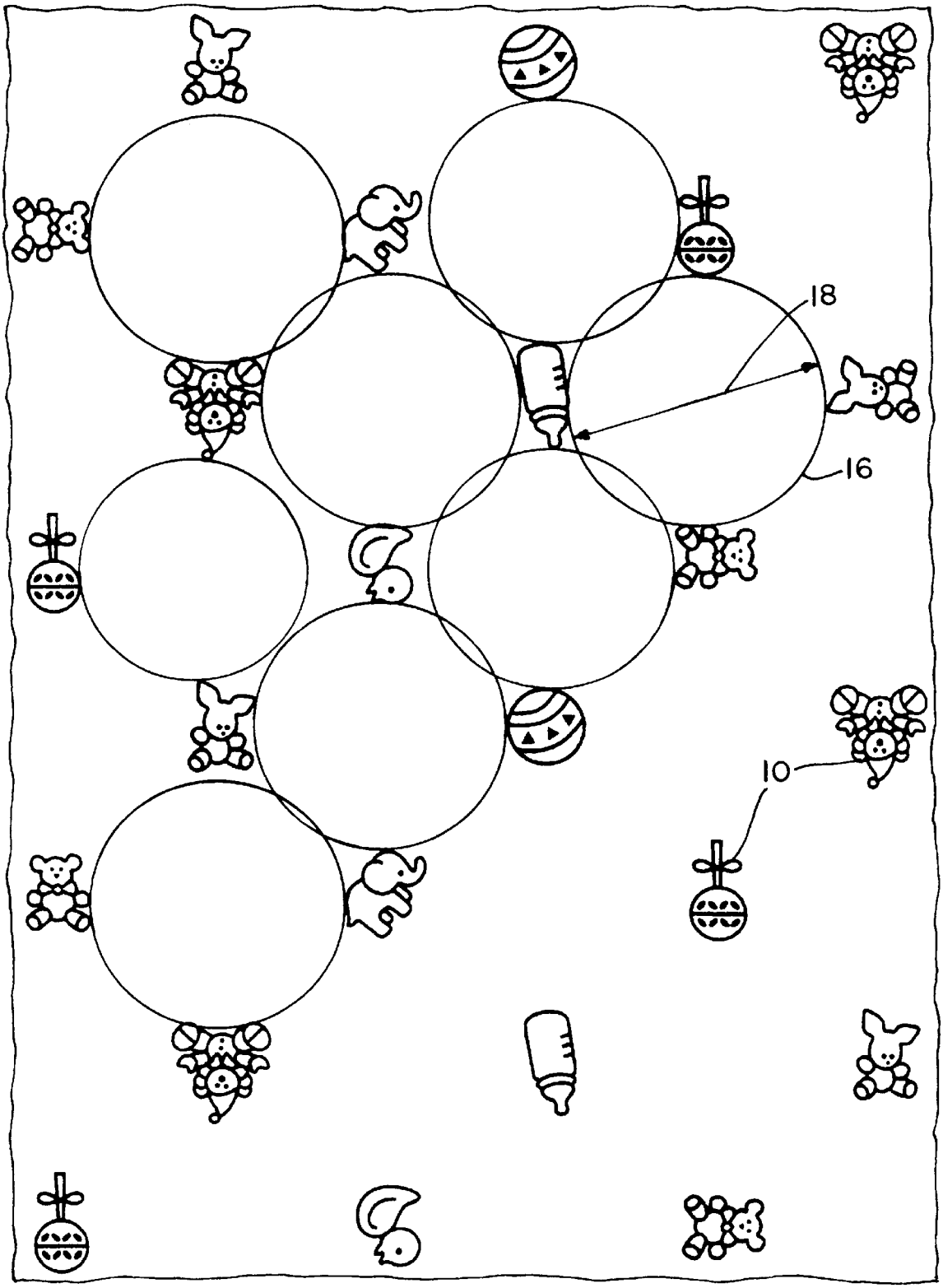
FIG. 4 is plan view of another emboss pattern of a wipe of the present invention.

The embossed pattern of Sample 4 is shown in FIG. 4. In this Sample, the size and spacing of the icons 10 varies. Therefore, the equivalent icon diameter and the equivalent unbonded area diameter shown in Table I are average values. As shown the equivalent icon diameter is on the order of one-half the nominal fiber length. Sample 4 represents an embossed pattern which leaves the CD bending torque and CD modulus essentially unchanged from the precursor web.

Figure 5:
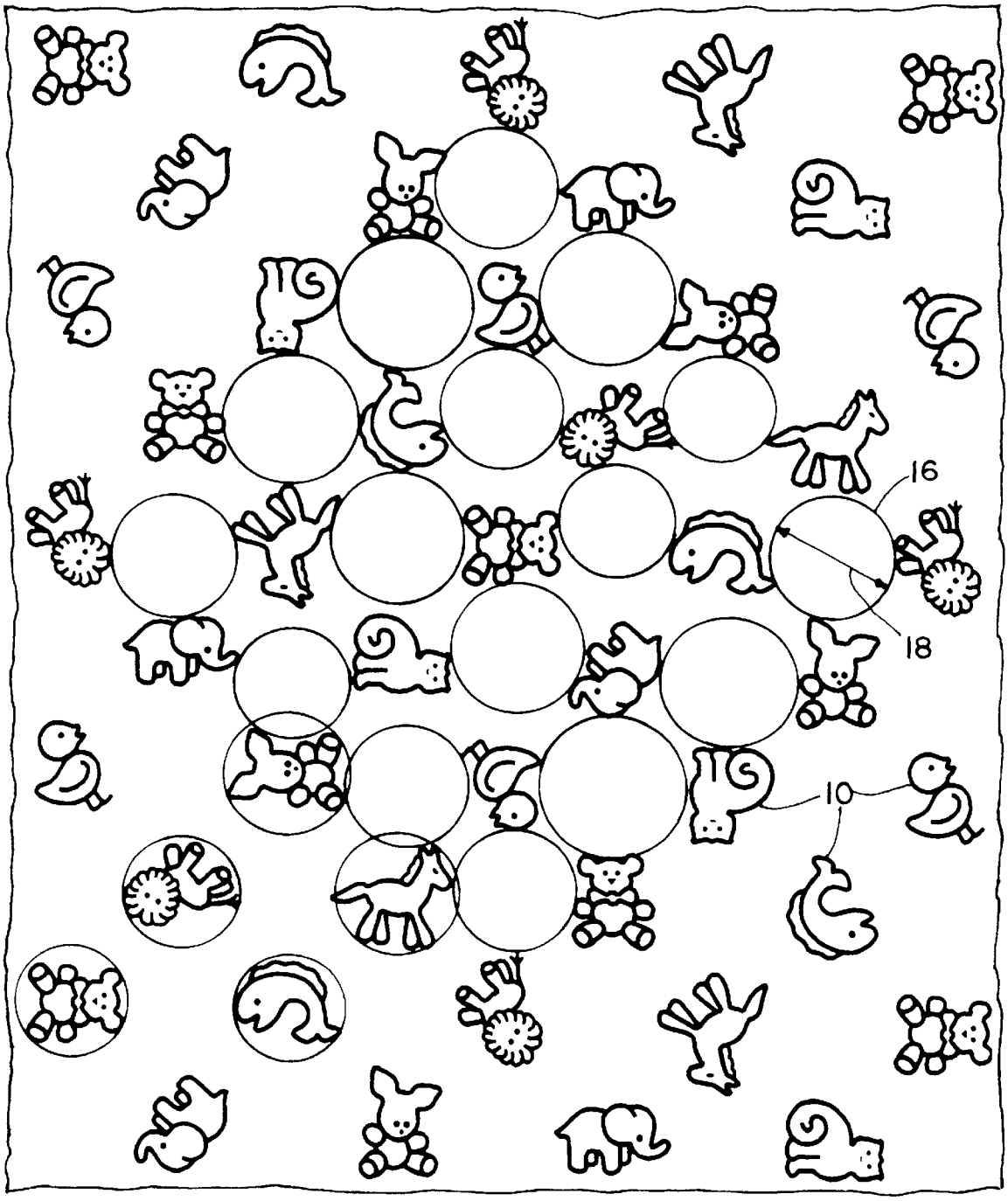
FIG. 5 is plan view of another emboss pattern of a wipe of the present invention.

The embossed pattern of Sample 5 is shown in FIG. 5. The icons 10 are the same as shown in FIG. 1, but the icon size has been decreased. That is, around each icon 10 can be circumscribed a circle 12 which has an equivalent icon diameter 14 which is less that of Sample 1. Likewise, between icons can be circumscribed a circle 16 which has an equivalent unbonded area diameter 18 which is less that that of Sample 1. The CD bending torque is shown in Table 1 as being the same as the precursor web, but Sample 5 represents an embossed pattern having a relatively high percent bond area (8.0%), which is reflected in the CD modulus. Without being bound by theory, it is believed that at higher than about 9–10% bond area, the CD modulus increases to an unacceptable degree.

Figure 6:
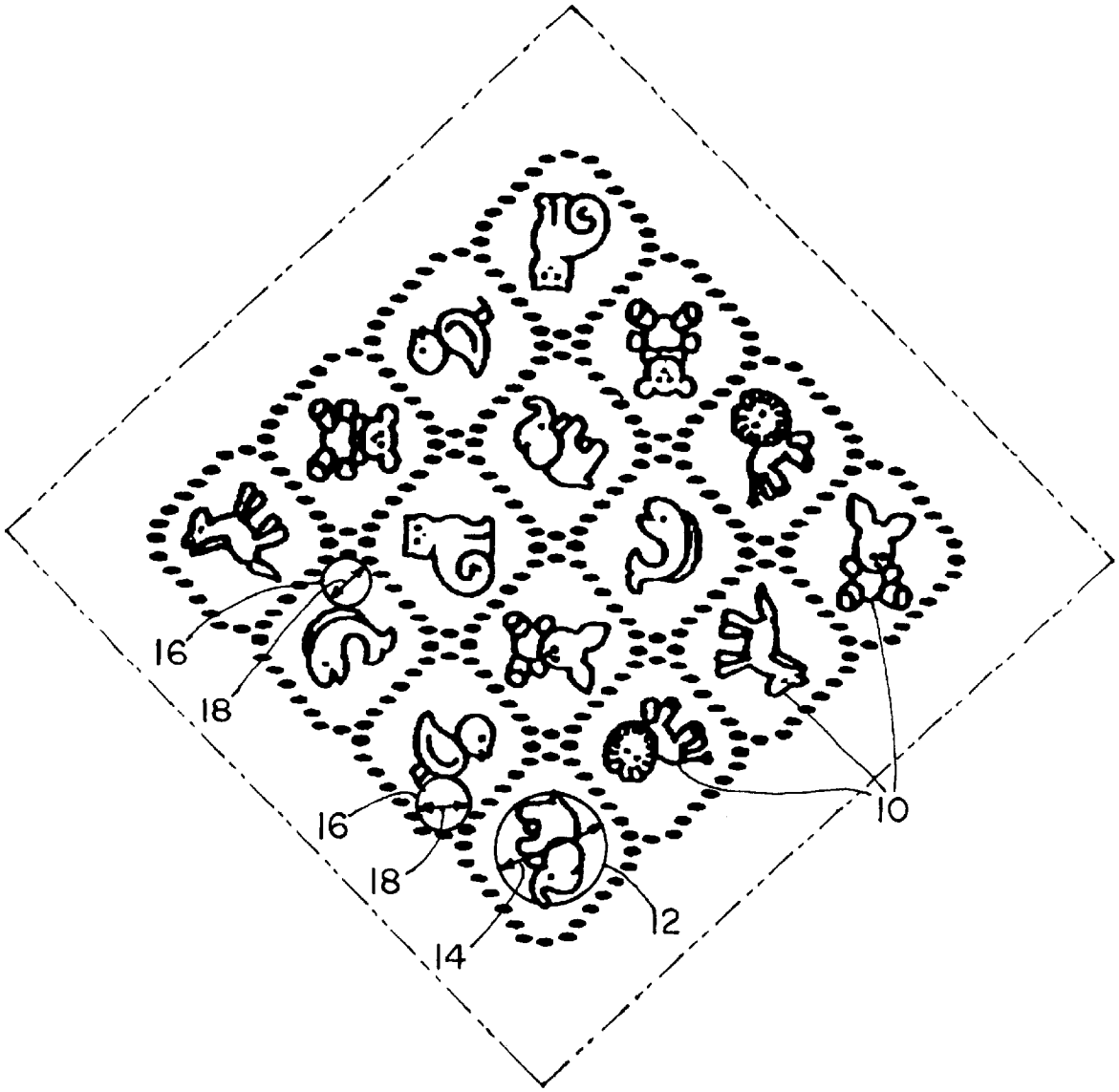
FIG. 6 is plan view of an emboss pattern of a wipe that is not suitable for use in a wipe of the present invention.

The embossed pattern of Sample 6 is shown in FIG. 6. The icons 10 are the same as shown in FIG. 5, but a grid pattern of closely spaced embossed oval shapes has been overlaid on the pattern of animal icons. This pattern is the same as that of the commercially successful baby wipes marketed in North America as PAMPERS® Baby Fresh™. Therefore, around each icon 10 can be superposed a circle 12 which has an equivalent icon diameter 14 which is the same as that of Sample 5. However, due to the presence of the intersecting lines of the grid pattern, between embossments a circle 16 can be superposed which has an equivalent unbonded area diameter 18 much less that that of Sample 5. The percent bond area is much greater that that believed acceptable for wipes of the present invention. Sample 6 represents an embossed pattern having a very high percent bond area (15.3%), which is reflected in the CD modulus. Without being bound by theory, it is believed that at a CD modulus greater than about 200 g/in makes the wipe unacceptably stiff for use as a pre-moistened baby wipe.

As shown, therefore, the wipe of the present invention can be embossed with an aesthetically-pleasing design of spaced apart discrete icons, without substantially compromising certain mechanical properties of the precursor nonwoven material. Therefore, the web of the present invention could be described as an embossed nonwoven web having a plurality of spaced apart discrete icons defining between about 4% and 8% total bond area, and exhibiting CD bending torque characteristics that differ insubstantially from the precursor web. The data in Table 1 for CD bending torque, for example, shows statistically insignificant differences in CD bending torque for the precursor web and webs embossed with those of the present invention.

Likewise, the present invention could be described as an embossed nonwoven web having a basis weight of about 62 gsm, and having a plurality of spaced apart discrete icons defining between about 4% and 8% total bond area, exhibiting CD elasic modulus less than about 200 g/in.

LOTION

The pre-moistend wipe of the presemt invention comprises an aqueous solution. The lotion is preferably at least about 85 percent by weight water, more preferably at least about 90 percent by weight water, and still more preferably at least about 95 by weight water. A currently preferably lotion is an oil-in-water emulsion type formulation comprising a polymeuic emulsifier, preferably sodium acrylates, and silicon oil, preferably dimethicone.

The lotion of the present invention can comprise an aqueous solutjion comprising a surfactant selected from the group consisiting of phosphate-quaternary amine compounds and non-ionic surfactants, and effective amounts of a second ingredient selected from the group consisting of non-cellulosic organic water soluble polymers and alkoxylated alcohols. These amount of these components can be adjusted in effective amounts to provide varying levels of adhesional wetting to account for various fold patterns and dispensing openings to deliver reliable wet wipe dispensing.

In another embodiment, the lotion can comprises a nonionic surfactant that is a block copolymer of propylene oxide and ethylene oxide. The propylene oxide block is sandwiched between two ethylene oxide blocks selected from the group consisting of Poloxamer 101-Poloxamer 407. A suitable nonionic surfactant is commercially available as Pluronic 62 brand available from BASF Corporation, Mount Olive, N.J.

The lotion preferably comprises less than about 3 percent by weight of the nonionic surfactant. More preferably, the lotion can comprise less than about 1 percent by weight of the nonionic surfactant. Even more preferably, the lotion comprises between about 0.2 and about 0.3 percent by weight of the nonionic surfactant.

In another preferred embodiment, the lotion comprises an inner salt of fatty quaternaryamines as a surfactant and a sulfonate of a fatty quaternary as a cosurfactant. The surfactant can be selected from the group consisting of Caprylamidopropyl Betaines, Cocoamidopropyl Betaines, Lauramidopropyl Betaine, Oleamidopropyl Bataine, or Isosteramidopropyl Betaine commercially available as Mackam: OAB, 35, L, J, DZ, LMB, and ISA from McIntyre Group Ltd., Governors Highway, University Park, Ill. A suitable cosurfactant is Cocamidopropyl Hydroxysultaine commercially available as Mackam CBS-50G from McIntyre Group Ltd., Governors Highway, University Park, Ill.

The lotion preferably comprises less than about 3 percent by weight of the inner salt of fatty quaternaryamines and less than about 1 percent by weight of the sulfonate of a fatty quaternary . More preferably, the lotion can comprise less than about 1 percent by weight of the inner salt of fatty quaternaryamines compound and less than about 0.7 by weight of the sulfonate of a fatty quaternary . Still more preferably, the lotion comprises between about 0.15 and about 0.36 percent by weight of the inner salt of fatty quaternaryamines compound and between about 0.1 and about 0.36 percent by weight of the sulfonate of a fatty quaternary .

The lotion preferably also comprises one or more of the following: an effective amount of a preservative, an effective amount of a humectant, an effective amount of an emollient; an effective amount of a fragrance, and an effective amount of a fragrance solubilizer.

As used herein, an emollient is a material that softens, soothes, supples, coats, lubricates, or moisturizes the skin. The term emollient includes, but is not limited to, conventional lipid materials (e.g. fats, waxes), polar lipids (lipids that have been hydrophylically modified to render them more water soluble), silicones, hydrocarbons, and other solvent materials. Emollients useful in the present invention can be petroleum based, fatty acid ester type, alkyl ethoxylate type, fatty acid ester ethoxylates, fatty alcohol type, polysiloxane type, mucopolysaccharides, or mixtures thereof.

Humectants are hygroscopic materials that function to draw water into the stratum comeum to hydrate the skin. The water may come from the dermis or from the atmosphere. Examples of humectants include glycerin, propylene glycol, and phospholipids.

Fragrance components, such as perfumes, include, but are not limited to water insoluble oils, including essential oils.

Fragrance solubilizers are components which reduce the tendency of the water insoluble fragrance component to precipitate from the lotion. Examples of fragrance solubilizers include alcohols such as ethanol, isopropanol, benzyl alcohol, and phenoxyethanol; any high HLB (HLB greater than 13) emulsifier, including but not limited to polysorbate; and highly ethoxylated acids and alcohols.

Preservatives prevent the growth of micro-organisms in the liquid lotion and/or the substrate. Generally, such preservatives are hydrophobic or hydrophilic organic molecules. Suitable preservatives include, but are not limited to parabens, such as methyl parabens, propyl parabens, and combinations thereof.

The lotion can also comprise an effective amount of a kerotolytic for providing the function of encouraging healing of the skin. An especially preferred kerotolytic is Allantoin ((2,5-Dioxo-4-Imidazolidinyl)Urea), a heterocyclic organic compound having an empirical formula $C_4H_6N_4O_3$. Allantoin is commercially available from Tri-K Industries of Emerson, New Jersey. It is well recognized that the long term wear of disposable absorbent structures, such as disposable diapers, may lead to skin which is compromised in terms of being over hydrated. It is generally known that hyperhydrated skin is more susceptible to skin disorders, including heat rash, abrasion, pressure marks and skin barrier loss. For example, 21 CFR 333.503 defines diaper rash as an inflammatory skin condition in the diaper area (perineum, buttocks, lower abdomen, and inner thighs) caused by one or more of the following factors: moisture, occlusion, chafing, continued contact with urine or feces, or mechanical or chemical irritation. A premoistened wipe according to the present invention can include an effective amount of allantoin for encouraging the healing of skin, such as skin which is over hydrated.

U.S. Pat. No. 5,534,265 issued Jul. 9, 1996; U.S. Pat. No. 5,043,155 issued Aug. 27, 1991; and U.S. Pat. No. 5,648,083 issued Jul. 15, 1997 are incorporated herein by reference for the purpose of disclosing additional lotion ingredients.

The lotion can further comprise between about 0.1 and about 3 percent by eight Allantoin, and about 0.1 to about 10 percent by weight of an aloe extract, such as aloe vera, which can serve as an emollient. Aloe vera extract is available in the form of a concentrated powder from the Rita Corporation of Woodstock, Ill.

Test Methods

Equivalent Icon Diameter:

1. Obtain a full scale and dimensionally accurate print of the full pattern repeat. This can be done by any known method, including printing out the pattern on paper.

2. For each unique icon in the pattern repeat, use a circle template to measure the diameter of the smallest circle that can circumscribe (i.e., be drawn about and encompass) the complete icon (as described with reference to the definition of equivalent icon diameter above). The measurement should be accurate within +/−1/32 inches. The diameter of the circle circumscribed is the equivalent icon diameter for the icon.
3. After recording the equivalent icon diameter for each unique icon in the pattern repeat, take the numerical average of theses values. This is the equivalent icon diameter for the pattern repeat.

Equivalent Unbonded Area Diameter

1. Obtain a full scale and dimensionally accurate print of the full pattern repeat. This can be done by any known method, including printing out the pattern on paper.
2. Use a circle template to measure the diameter of the largest circle that can be circumscribed between icons within the pattern repeat and that can be circumscribed between the icons in one pattern repeat and the icons in adjacent pattern repeats, but in no case does it include any embossed portions within it (as described with reference to the definition of equivalent unbonded area diameter above). The measurement should be accurate within +/−1/32 inches. The diameter of each circle circumscribed is the equivalent unbonded area diameter for that portion of the pattern.
3. After recording all of the equivalent unbonded area diameters, take the numerical average of theses values. This is the average equivalent unbonded area diameter for the pattern repeat and adjacent repeats.

Percent Bond Area

1. Obtain a full scale and dimensionally accurate print of the full pattern repeat which has the embossments shown in black and the non-embossments shown in white. This can be done in any known method, including printing out a to-scale pattern in black ink on white paper.
2. The total area of the pattern repeat is determined by measuring a known geometric shape, such as a square, rectangle, rhombus, etc. that encompasses all of the pattern repeat.
3. The total embossed area of the pattern repeat is measured by determining the area defined by all black regions within the pattern repeat. This can be done by scanning the pattern into a computer graphic file and using computer software such as Image 1.44 for Macintosh PC, PC Paint, Micrographics Designer, Adobe Illustrator, to determine the area of the black pixels within the geometric region established in Step 2 above. Alternatively, the total embossed area can be determined manually by superimposing a geometric grid consisting of 0.030 inch by 0.030 inch squares can on the geometric region established in Step 2. In this case the total embossed area is the total area of squares that are at least 50% black.
4. The percent bond area equals the ratio of the total embossed area and total pattern repeat area times 100.

CD Bending Torque

The CD bending torque was measured using a Kawabata KES-FB2 pure bending tester. This test is part of the Kawabata system which is designed to measure basic mechanical properties of nonwovens, and other web materials. Bending torque was established by averaging the results of at least three samples tested according to the following criteria:

Sample size=8.9 cm×8.9 cm Lotion saturation=3.4 g/g Calibration mass=50 grams Instrument sensitivity=5×1

Front moving jaw to rear moving jaw gap setting=1 cm

Sided orientation of sample=none

Number of bending cycles per measurements=4

Cycle curvature=0 $cm^{-1}$ to +1 $cm^{-1}$ to −1 $cm^{-1}$ to 0 $cm^{-1}$

Cycle rate=0.5 $cm^{-1}$/sec

Number of measurements=10

Bending torque (g-cm)=slope of linear regression line between approximately 0.2 $cm^{-1}$ and 0.7 $cm^{-1}$ of the Moment (g-cm/cm) vs. Curvature 1(/cm curve)

CD Modulus

Figure 7:
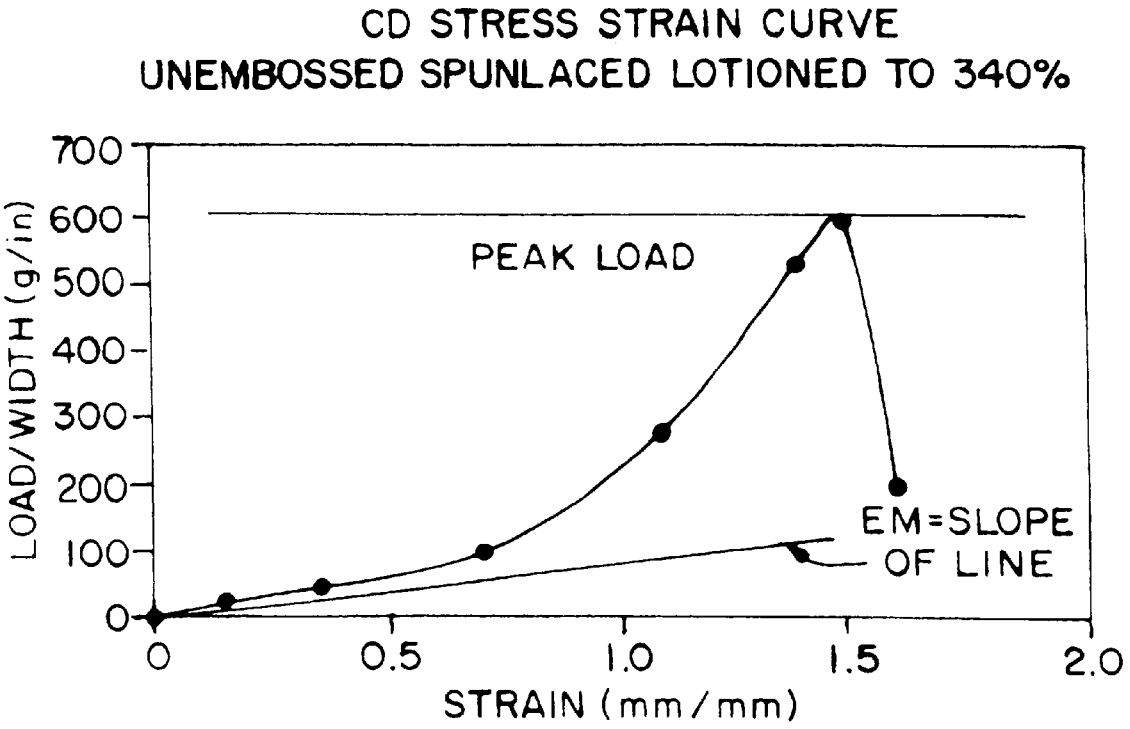
FIG. 7 is a graph showing a typical stress-strain curve of a web of the present invnetion.

The CD modulus was tested by the MTS #7997 device. In particular, a sample having a 25.4 mm width was cut from a nonwoven wipe of the present invention, being careful that the width dimension was in the machine direction, that is, the dimension to be strained is the cross-direction. The tensile equipment was set with a 102 mm jaw separation, and a 100 mm/min strain rate. The wipe samples were tested pre-moistened with an oil-in-water emulsion, with the level of saturation being 340%, that is, 3.4 grams of lotion per gram of dry substrate. Elastic modulus, Em, is defined as the slope of the linear part of the load/sample width verses strain curve. If more than one linear region can be identified, the elastic modulus for the substrate is defined by the linear section with the smallest slope as shown in the graph of FIG. 7.

Accordingly, while particular embodiments of the present invention have been illustrated and described, it would be obvious to those skilled in the art that various other changes and modifications can be made without departing from the spirit and scope of the invention. It is therefore intended to cover in the appended claims all such changes and modifications, including combinations of features disclosed, that are within the scope of this invention.

What is claimed is:

1. A wipe comprising a nonwoven web comprised of thermoplastic fibers having a predetermined nominal fiber length, the wipe being calendar-embossed with a pattern comprising a plurality of discrete icons, each said icon having an equivalent icon diameter of at least about one half the nominal fiber length, and said plurality of icons being separated one from another by an equivalent unbonded area diameter of at least about one half the nominal fiber length and wherein said wipe further comprises an aqueous solution.

2. The wipe of claim 1, wherein said nonwoven is spunlaced.

3. The wipe of claim 1, wherein said fibers further comprise viscose.

4. The wipe of claim 3, wherein said fibers comprise from 40% to 60% viscose, with the remainder of the fiber content being said thermoplastic fibers.

5. The wipe of claim 4, wherein said thermoplastic fibers comprise polyolefin material.

6. The wipe of claim 5, wherein said polyolefin material is polypropylene.

7. The wipe of claim 1, wherein said predetermined fiber length is nominally between about 0.5 and 3.0 inches.

8. The wipe of claim 1, wherein said predetermined fiber length is nominally between about 1.0 and 2.0 inches.

9. The wipe of claim 1, wherein said predetermined fiber length is nominally about 1.5 inches.

10. The wipe of claim 1, wherein said discrete icons have substantially equal equivalent icon diameters.

11. An embossed nonwoven web formed from a precursor web comprised of fibers having a fiber length of nominally between about 0.5 and 3.0 inches and having a plurality of spaced apart discrete icons defining between about 4% and 8% total bond area, said web exhibiting CD bending torque characteristics that differ insubstantially from the precursor web and wherein said web further comprises an aqueous solution.

12. The web of claim 11, wherein said nonwoven is spunlaced.

13. The web of claim 11, wherein said fibers further comprise viscose.

14. The web of claim 13, wherein said fibers comprise from 40% to 60% viscose, with the remainder of the fiber content being said thermoplastic fibers.

15. The web of claim 14, wherein said thermoplastic fibers comprise polyolefin material.

16. The web of claim 15, wherein said polyolefin material is polypropylene.

17. The web of claim 11, wherein said predetermined fiber length is nominally between about 1.0 and 2.0 inches.

18. The web of claim 11, wherein said predetermined fiber length is nominally about 1.5 inches.

19. An embossed nonwoven web formed from a precursor web comprised of fibers having a fiber length of nominally between about 0.5 and 3.0 inches and having a plurality of spaced apart discrete icons defining between about 4% and 8% total bond area, said wipe exhibiting a CD elastic modulus less than 200 g/in and wherein said web further comprises an aqueous solution.

20. The web of claim 19, wherein said nonwoven is spunlaced.

21. The web of claim 19, wherein said fibers further comprise viscose.

22. The web of claim 21, wherein said fibers comprise from 40% to 60% viscose, with the remainder of the fiber content being said thermoplastic fibers.

23. The web of claim 22, wherein said thermoplastic fibers comprise polyolefin material.

24. The web of claim 23, wherein said polyolefin material is polypropylene.

25. The web of claim 19, wherein said predetermined fiber length is nominally between about 1.0 and 2.0 inches.

26. The web of claim 19, wherein said predetermined fiber length is nominally about 1.5 inches.

* * * * *

UNITED STATES PATENT AND TRADEMARK OFFICE

CERTIFICATE OF CORRECTION

PATENT NO. : 6,361,784 B1
DATED : March 26, 2002
INVENTOR(S) : Brennan et al.

It is certified that error appears in the above-identified patent and that said Letters Patent is hereby corrected as shown below:

Column 6,
Lines 4 and 7, delete “eight” and insert therefor -- weight --.

Column 10,
Line 59, after “the”, insert therefor -- web of the --.
Line 62, after “area,” insert therefor -- and --.
Line 66, delete “pre-moistend” and insert therefor -- pre-moistened --.
Line 66, delete “presemt” and insert therefor -- present --.

Column 11,
Line 3, after “95” insert therefor -- percent --.
Line 3, delete “preferably” and insert therefor -- preferred --.
Line 5, delete “polymeuic” and insert therefor -- polymeric --.
Line 8, delete “solutjion” and insert therefor -- solution --.
Line 9, delete “consisiting” and insert therefor -- consisting --.

Column 12,
Line 12, delete “comeum” and insert therefor -- corneum --.
Line 57, delete “eight” and insert therefor -- weight --.

Column 16,
Line 3, delete “wipe” and insert therefor -- web --.

Signed and Sealed this

Fifth Day of April, 2005

JON W. DUDAS
*Director of the United States Patent and Trademark Office*